US009882313B2

(12) United States Patent
Steinbuchel, IV et al.

(10) Patent No.: US 9,882,313 B2
(45) Date of Patent: Jan. 30, 2018

(54) ELECTRICAL PLUG ADAPTER HAVING SOCKET KEY SAFETY SYSTEM

(71) Applicant: AEROVIRONMENT, INC., Monrovia, CA (US)

(72) Inventors: Herman Joseph Steinbuchel, IV, Pasadena, CA (US); Larry Hayashigawa, Downey, CA (US); Ronald Lee Norton, Monrovia, CA (US); David Paul Soden, Mission Viejo, CA (US); Thomas Michael Zevin, Valencia, CA (US); Albert Joseph Flack, Lake Arrowhead, CA (US)

(73) Assignee: AEROVIRONMENT, INC., Simi Valley, CA (US)

( * ) Notice: Subject to any disclaimer, the term of this patent is extended or adjusted under 35 U.S.C. 154(b) by 14 days.

(21) Appl. No.: 14/852,267

(22) Filed: Sep. 11, 2015

(65) Prior Publication Data

US 2016/0190744 A1 Jun. 30, 2016

Related U.S. Application Data

(63) Continuation of application No. PCT/US2014/029624, filed on Mar. 14, 2014.
(Continued)

(51) Int. Cl.
*H01R 13/645* (2006.01)
*H01R 31/06* (2006.01)
(Continued)

(52) U.S. Cl.
CPC ..... *H01R 13/6456* (2013.01); *H01R 13/64* (2013.01); *H01R 24/22* (2013.01);
(Continued)

(58) Field of Classification Search
CPC ... H01R 13/64; H01R 13/6456; H01R 13/106
See application file for complete search history.

(56) References Cited

U.S. PATENT DOCUMENTS 3,123,423 A 3/1964 Schmitt
4,725,240 A 2/1988 Braverman
(Continued)

OTHER PUBLICATIONS

Nema,Nema 5-15 and 5-20 Plug and Socket Photos,Jul. 19, 2010, [retrieved on Jul. 7, 2014], Retrieved from the Internet,<URL:http://www.stjosephmuisicfoundation.org/documents/Nema.pdf>.
(Continued)

*Primary Examiner* — Briggitte R Hammond
(74) *Attorney, Agent, or Firm* — Michael Zarrabian; Pejman Yedidsion; Eric Aagaard

(57) ABSTRACT

An electric vehicle ("EV") charger plug adapter apparatus includes an adapter housing, a socket extending into a first side of the adapter housing, the socket configuration defined by a first technical standard for use with at least one of a first current or voltage rating, a plug extending from a second side of the adapter housing, the plug configuration defined by a second technical standard for use with at least one of a second current or voltage rating, and a key extending from the first side of the adapter housing, wherein the key prevents seating of a second plug into the socket if the second plug does not have a complementary key socket to fit the key.

27 Claims, 6 Drawing Sheets

Related U.S. Application Data

(60) Provisional application No. 61/801,121, filed on Mar. 15, 2013.

(51) Int. Cl.

| | |
|---|---|
| ***H01R 13/64*** | (2006.01) |
| ***H01R 24/22*** | (2011.01) |
| ***H01R 24/30*** | (2011.01) |
| *H01R 103/00* | (2006.01) |
| *H01R 13/639* | (2006.01) |

(52) U.S. Cl.

CPC ..... *H01R 24/30* (2013.01); *H01R 31/06* (2013.01); *H01R 13/6392* (2013.01); *H01R 2103/00* (2013.01)

(56) References Cited

U.S. PATENT DOCUMENTS

| | | | |
|---|---|---|---|
| 5,791,921 | A | 8/1998 | Lee |
| 6,699,052 | B1 | 3/2004 | Poran |
| 2002/0055288 | A1 | 5/2002 | Philips et al. |
| 2003/0181082 | A1 | 9/2003 | Wu |
| 2004/0102102 | A1 | 3/2004 | Schwarz et al. |
| 2009/0079389 | A1 | 3/2009 | Ohtomo |
| 2012/0139335 | A1 | 6/2012 | Holland |

OTHER PUBLICATIONS

International Search Report from PCT/US2014/029624 dated Jul. 29, 2014.

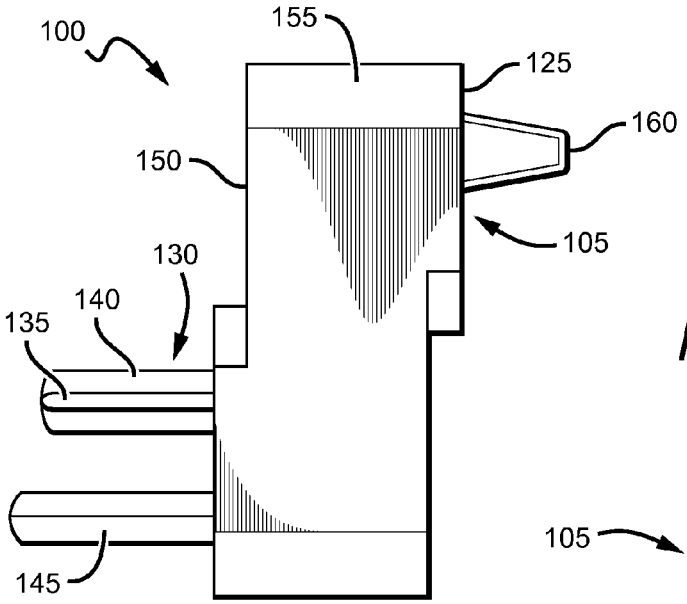
FIG. 1A
FIG. 1B
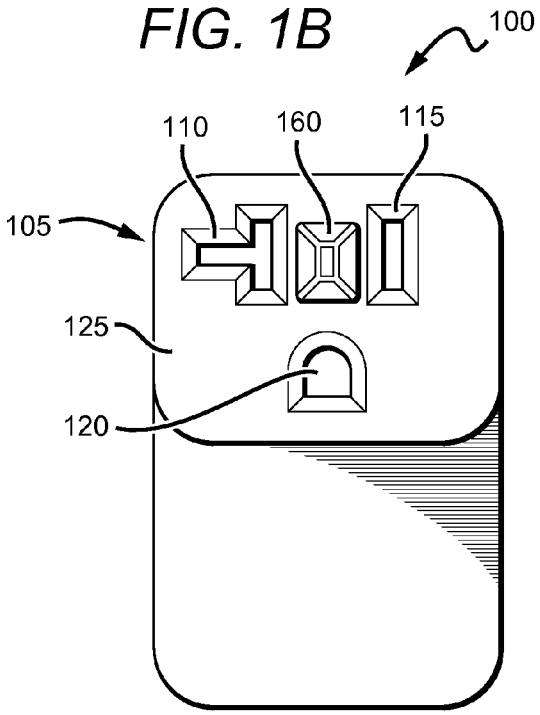
FIG. 1C
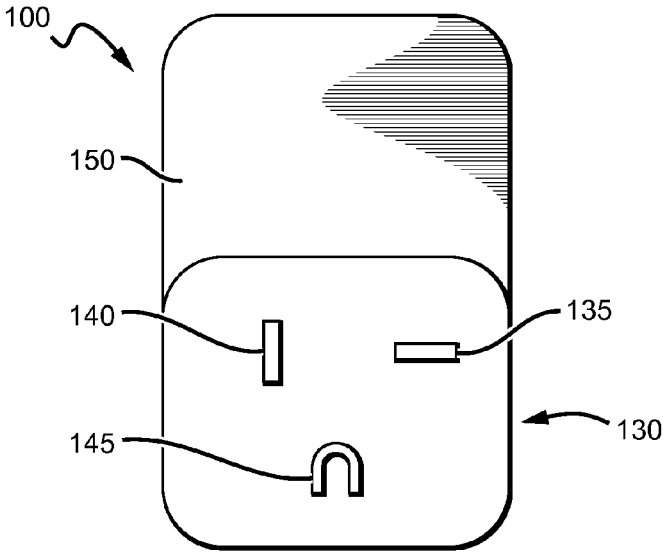

ELECTRICAL PLUG ADAPTER HAVING SOCKET KEY SAFETY SYSTEM

CROSS-REFERENCE TO RELATED APPLICATIONS

This invention is a continuation of International Patent Application No. PCT/US2014/029624, filed Mar. 14, 2014, which claims priority to and the benefit of U.S. Provisional Patent Application Ser. No. 61/801,121 filed Mar. 15, 2013, both of which are hereby incorporated herein by reference in their entirety for all purposes.

FIELD OF THE INVENTION

The field of the invention relates to electrical plug adapters.

BACKGROUND

National technical standards exist to define the physical and electrical characteristics of electrical plugs and their associated sockets. The intent of the technical standards is to promote safety and operability between power sources and products that require power. Historically, a particular product would be designed for a specific source voltage and maximum current source and so would be manufactured with a fixed plug that is configured to insert into its complementary power-source socket. For example, a product requiring 110 volts and drawing a maximum of 15 A current would be configured with a National Electrical Manufacturers Association (NEMA) 5-15 plug for insertion into a NEMA 5-20 socket. A NEMA 5-15 plug is configured per its NEMA technical standard so that it cannot be inserted into a higher-power NEMA 6-20 socket. More recently, however, products are manufactured having built-in power electronics that are capable of converting various input power into an appropriate power for the device. While a device might be configured with a NEMA 5-15 plug, it may be operable with power provided by a NEMA 6-20 socket, even though not physically able to be inserted into the NEMA 6-20 without an adapter of some sort.

Unfortunately, not every product has build-in power electronics that are capable of adapting to various source voltages. A user that purchases an off-the-shelf electrical plug adapter to make use of a socket defined by a first technical standard for their product having a plug defined by a second technical standard may inadvertently trip safety breakers on the power source or destroy their product (i.e., the "load") because of an incompatible source voltage. A need continues to exist to protect power sources and products from incompatible adapter and electronic product combinations.

SUMMARY

An exemplary device embodiment may comprise: a socket assembly defined by a first technical standard; a plug defined by a second technical standard; and at least one key extending out from a face of the socket assembly; where the socket assembly can receive a second plug having at least one key socket to receive at least a portion of the at least one key. In additional exemplary device embodiments, the at least one key may prevent seating into the socket assembly of a third plug that is complementary to the socket assembly if the third plug does not comprise at least one key socket that is complementary to the at least one key. In additional exemplary device embodiments, the second plug may be defined by the first technical standard, and the second plug may be able to carry power associated with the second technical standard. In additional exemplary device embodiments, at least one of the at least one key may be disposed between a power socket and a ground socket of the socket assembly. In additional exemplary device embodiments, at least one of the at least one key may be a geometric frustum. In additional exemplary device embodiments, the at least one key may be at least one of: straight and serpentine. In additional exemplary device embodiments, the at least one key may be comprised of at least one of: a rigid thermoplastic, a rigid thermosetting polymer, metal, and ceramic. In additional exemplary device embodiments, the device may comprise two keys. In additional exemplary device embodiments, the two keys may be aligned and centered between a neutral socket and a power socket of the socket assembly. In additional exemplary device embodiments, the two keys may be positioned adjacent to at least one of: a neutral socket, a power socket, and a ground socket of the socket assembly. In additional exemplary device embodiments, the socket assembly may comprise a neutral socket, a power socket, and a ground socket, and the plug may comprise a neutral blade, a power blade, and a ground blade. In additional exemplary device embodiments, the neutral socket may be electrically coupled to the neutral blade, the power socket may be electrically coupled to the power blade, and the ground socket may be electrically coupled to the ground blade. In additional exemplary device embodiments, the at least one key may comprise a walled structure. In additional exemplary device embodiments, the walled structure may separate each of the neutral socket, the power socket, and the ground socket on the face of the socket assembly. In additional exemplary device embodiments, the walled structure may be at least one of: a uniform height and a varying height. In additional exemplary device embodiments, the device may further comprise a device housing, where the socket assembly and the plug may be disposed on opposing sides of the device housing. In additional exemplary device embodiments, the device housing may be generally rectangular in cross-section. In additional exemplary device embodiments, the device housing may be comprised of at least one of: a rigid thermoplastic and a rigid thermosetting polymer. In additional exemplary device embodiments, the device housing may further comprise a flexible portion disposed between the socket assembly and the plug. In additional exemplary device embodiments, the device housing may further comprise one or more longitudinal slots to receive a clip for slidable coupling with an electric vehicle ("EV") power adapter comprising the second plug.

An electric vehicle ("EV") charger plug adapter apparatus may include an adapter housing, a socket extending into a first side of the adapter housing, the socket configuration defined by a first technical standard for use with at least one of a first current or voltage rating, a first plug extending from a second side of the adapter housing, the first plug configuration defined by a second technical standard for use with at least one of a second current or voltage rating, and a key extending from the first side of the adapter housing, where the key prevents seating of a second plug into the socket if the second plug does not have a complementary key socket to fit the key. In one embodiment, the first technical standard is National Electrical Manufacturers Association (NEMA) 5-15 standard. The second technical standard may be selected from the group consisting of NEMA 6-15, NEMA 5-20, and NEMA 6-20 standards. The key may be in the form of a geometric frustum, and the geometric frustum may be a peg. In and the plurality of protrusions may be disposed between power and neutral prongs of the plug. The key may include a walled structure. The adapter housing comprises a flexible cable connecting the first and second sides.

An EV charger plug adapter method is also disclosed that may include plugging a first plug extending from a second side of an adapter housing into a complementary socket, the first plug configuration defined by a second technical standard for use with at least one of a second current or voltage rating, and blocking a second plug from mating with a socket extending into a first side of the adapter housing, the socket configuration defined by a first technical standard for use with at least one of a first current or voltage rating, the blocking being accomplished using a key extending from the first side of the adapter housing.

An EV charger plug adapter system may include an adapter housing, a socket extending into a first side of the adapter housing, the socket configuration defined NEMA 5-15, a first plug extending from a second side of the adapter housing, the first plug configuration defined by a second technical standard selected from the group consisting of NEMA 6-15, NEMA 5-20, and NEMA 6-20 standards, and at least one key protrusion extending from the first side of the adapter housing, where the key protrusion prevents seating of a second plug into the socket if the second plug does not have a complementary key socket to fit the key. In such an embodiment, the system may also include an EV charging cord plug seated in the socket, and a coupler coupled to the adapter housing and EV charging cord plug, where the EV charging cord plug is tethered to the housing by the coupler.

An exemplary system embodiment may comprise: an adapter comprising: a socket defined by a first technical standard and comprising a neutral socket, a power socket, and a ground socket; a plug defined by a second technical standard and comprising a neutral blade, a power blade, and a ground blade; at least one key extending out from a face of the socket; and an adapter housing, where the socket and the plug are disposed on opposing sides of the adapter housing; an electric vehicle ("EV") power adapter, the EV power adapter comprising: a second plug compatible with the first technical standard and comprising a second neutral blade, a second power blade, and a second ground blade; and at least one complementary key socket extending inward from a face of the second plug, where the at least one complementary key socket is aligned with the at least one key of the adapter;

where the socket of the adapter is configured to receive the second plug of the EV power adapter, and the at least one complementary key socket is configured to receive the at least one key so as to electrically couple the second neutral blade to the neutral socket and the neutral blade, electrically couple the second power blade to the power socket and the power blade, and electrically couple the second ground blade to the ground socket and the ground blade. In additional exemplary system embodiments, the at least one key may be configured to prevent electric coupling of a device comprising a third plug with the adapter comprising the socket if the third plug does not have at least one complementary key socket aligned with the at least one key of the adapter.

An exemplary device embodiment may comprise a socket assembly, where the socket assembly is configured to receive a plug of a first technical standard; a first plug assembly, where the first plug assembly is configured to be capable of insertion into a socket defined by a second technical standard; and at least one key extending out from a face of the socket assembly; where the at least one key allows the socket assembly to receive a plug having at least one key socket to receive at least a portion of the at least one key. An exemplary device embodiment may also comprise: a socket assembly defined by a first power rating; a plug defined by a second power rating; and at least one key extending out from a face of the socket; where the socket assembly can receive a second plug having at least one key socket to receive at least a portion of the at least one key y. In additional exemplary device embodiments, the at least one key may prevent seating into the socket assembly of a third plug that is complementary to the socket assembly if the third plug does not comprise at least one key socket that is complementary to the at least one key. In additional exemplary device embodiments, the second plug may be defined by a first power rating corresponding to a first technical standard, and the second plug may be able to carry power associated with the second power rating that may correspond to a second technical standard. In additional exemplary device embodiments, the second power rating may be greater than the first power rating. In additional exemplary device embodiments, the socket assembly may comprise a neutral socket, a power socket, and a ground socket, and the plug may comprise a neutral blade, a power blade, and a ground blade. In additional exemplary device embodiments, the neutral socket may be electrically coupled to the neutral blade, the power socket may be electrically coupled to the power blade, and the ground socket may be electrically coupled to the ground blade.

BRIEF DESCRIPTION OF THE DRAWINGS

The components in the figures are not necessarily to scale, emphasis instead being placed upon illustrating the principals of the invention. Like reference numerals designate corresponding parts throughout the different views.

FIGS. 1A, 1B, and 1C are right side elevational, front elevational, and rear elevational views, respectively.

DETAILED DESCRIPTION

Figure 1D:
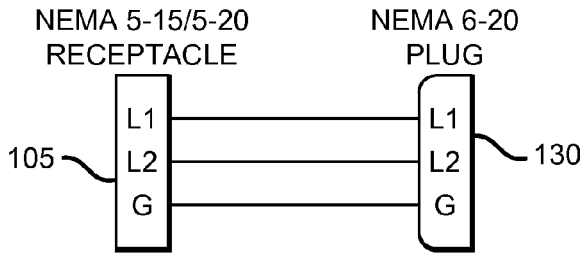
FIG. 1D is a wiring schematic illustrating one embodiment of an electrical adapter having a socket and plug defined by different respective technical standards.

An electrical adapter is described that has a socket on one end that is defined by a first technical standard and a plug on the other end that is defined by a second technical standard, with the socket-side of the adapter having a proprietary key (alternately called a "socket key") extending from it thereby preventing the socket's use with a plug that does not have the complementary key recess. In some embodiments, the socket assembly may be defined by a first power rating and the plug may be defined by a second power rating. The second power rating may be configured to carry a greater power load than the first power rating. A second plug, which may have the first power rating, may be plugged into the socket and carry the power load associated with the second power rating. With such a proprietary keying scheme, the electrical adapter is operable to work only with predefined plug/socket combinations to avoid inadvertent source-power failure or inadvertent overpowering of the load.

FIGS. 1A, 1B and 1C are right side elevational, front elevational, and rear elevational views, respectively, illustrating one embodiment of an electrical adapter having a socket and plug defined by different respective technical standards. As used herein, a "standard" is a formalized public document that defines a uniform physical and/or electrical configuration for a product, whether promulgated by a standards body, regulatory body or as a "de facto" standard promulgated by a company. Technical standards include the standards promulgated by the US. National Electrical Manufacturers Association ("NEMA") for use with AC power plugs, including NEMA 5-15, NEMA 6-15, NEMA 5-20, and NEMA 6-20, but may include technical standards defining electrical plugs and sockets from bodies or companies outside of the United States. Although a particular standard may have sub sections defining a socket configuration and plug configuration (and so designated with an 's' or 'p'), the description herein treats "a technical standard" as encompassing both socket and plug configurations in the same technical standard. The electrical connector 100 may be configured with a socket defined by a first technical standard, such as a NEMA 5-15s socket 105 having neutral, power and ground sockets (110, 115, 120) on a first side 125 to connect with a NEMA 5-15p plug (not shown). The electrical connector 100 may also be configured with a plug defined by a second technical standard, such as a NEMA 6-20p plug 130 having neutral, power, and ground blades (135, 140, 145) on a second side 150. The electrical connections between the socket 105 and plug 130 are affixed to and contained within a housing 155 that is generally rectangular in cross section.

The adapter 100 may have a key 160 such as a square frustum extending from the first side 125 of the adapter housing. In a preferred embodiment, the key extends to a distance that would prevent a plug that is complementary to the socket 105 from seating properly to prevent the socket's use.

FIG. 1D is a schematic mapping of electrical paths between the socket 105 and the plug 130. As illustrated, terminals L1, L2, and G (135, 140, 145) of plug 130 are electrically coupled to terminals L1, L2 and G (110, 115, 120) of the socket 105. In one embodiment, L1 represents neutral terminals, L2 represents power terminals and G represents ground terminals for socket 105 and plug 130.

Figure 2A:
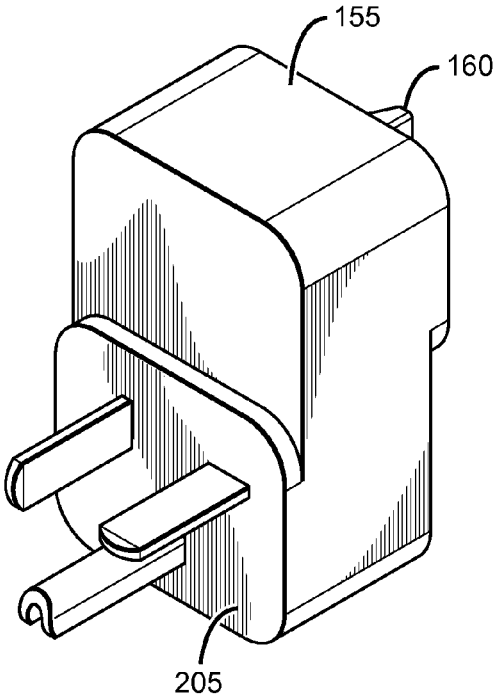
FIGS. 2A and 2B are rear perspective and front perspective views, respectively, of the electrical adapter first illustrated in FIGS. 1A, 1B, and 1C.
Figure 2B:
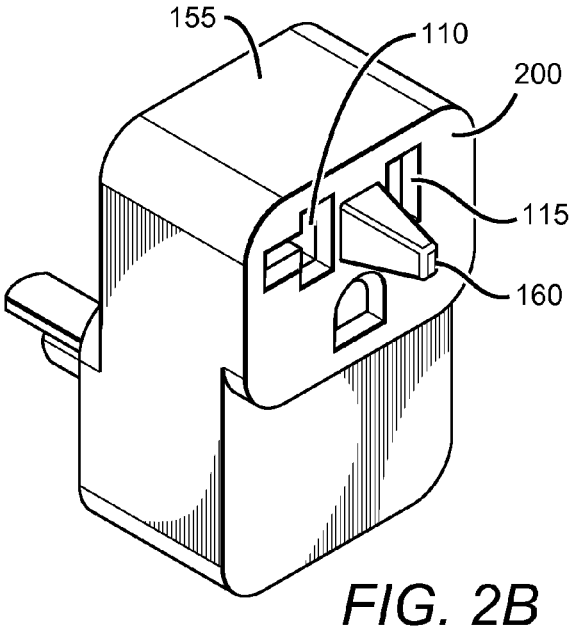

FIGS. 2A and 2B are rear perspective and front perspective views, respectively, of the electrical adapter first illustrated in FIGS. 1A, 1B, and 1C. The housing 155 has socket and plug faces (200, 205) whose perimeter's encompass an area equal to or greater than that defined by the UL 498A standard. Within that area, and generally between the neutral and power sockets (110, 115), may be the key 160 extending up from the socket face 200. The key 160 may be cast, extruded or otherwise formed with the body of the housing 155 during manufacturing or may be a component coupled to the housing. In one embodiment, the key 160 may be formed of plastic such as a rigid thermoplastic or rigid thermosetting polymer. In other embodiments, the key 160 may be formed from metal or ceramic. The housing 155 may also be formed of a rigid thermoplastic or rigid thermosetting polymer.

Figure 3A:
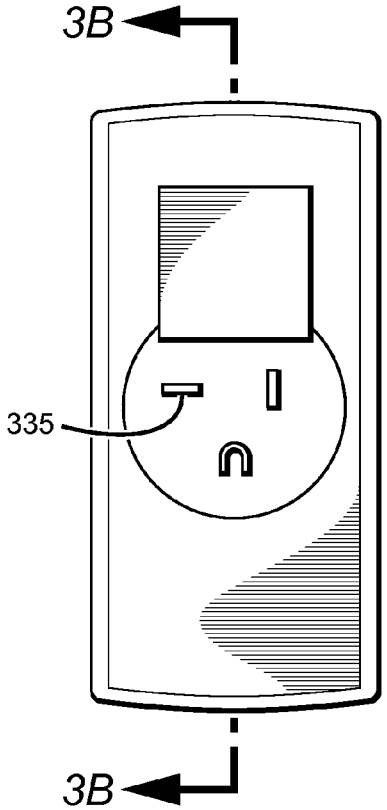
FIGS. 3A and 3B are back elevational and cross section views, respectively, of one embodiment of an electrical adapter seated in an EV power adapter.
Figure 3B:
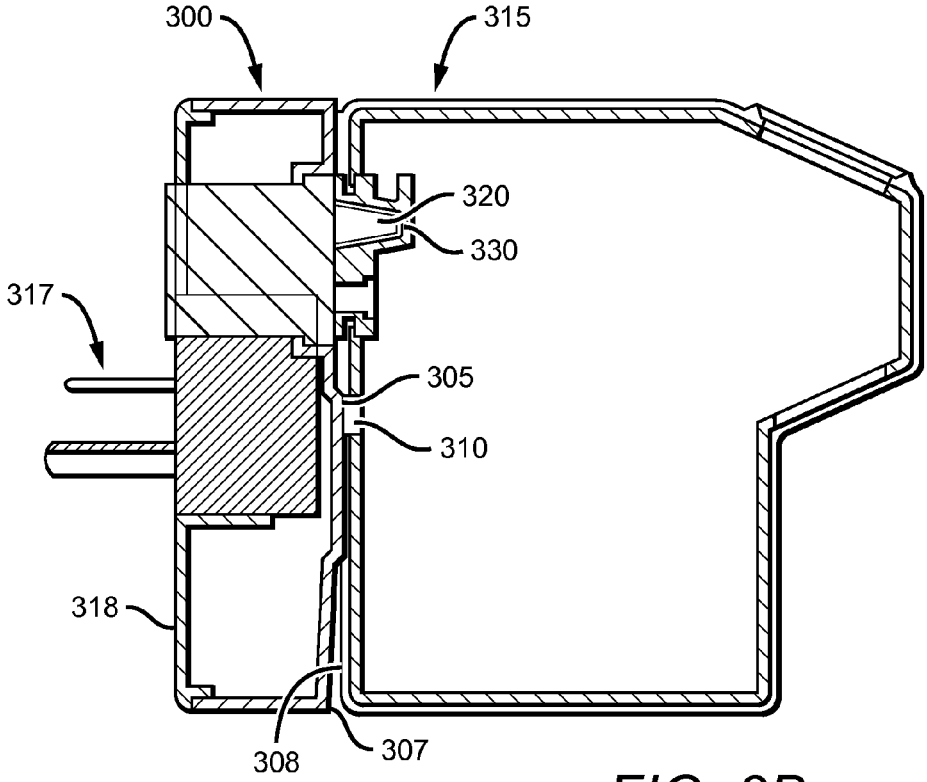

FIGS. 3A and 3B are back elevational and cross section views, respectively, of one embodiment of an electrical adapter seated in an EV power adapter. The electrical adapter 300 has a socket 305 on a first side 307 that is configured with neutral, power and ground sockets to accept a plug (including neutral blade 310) extending from a first side 308 of a EV power adapter 315. An adapter plug 317 extends from a second side 318 of the electrical adapter. A socket key 320 may extend from the first side 307 of the electrical adapter 300 to seat in a complementary key socket 330 in the first side 308 of the EV power adapter 315 to enable the neutral blade 310, power blade and ground prong (not shown) to fully seat in the electrical adapter 300 to define the EV power adapter as "compatible" with the electrical adapter. In an alternative embodiment, the key 320 may include a plurality of projections, may be defined by a walled structure or some other physical key that enables a compatible component to mate with the electrical connector while preventing the inadvertence mating of inappropriate components. The first side 307 of the electrical adapter 300 and the first side 308 of the EV power adapter 315 may each be generally planar to enable complete seating of the neutral blade 310 into the electrical connector neutral socket 305. The first face 307 of the electrical adapter 300 may be defined by a first technical standard for use with a first current or voltage rating, such as NEMA 5-15, and the first face 308 of the EV power adapter 315 may be defined by the same technical standard (NEMA 5-15). The adapter plug 317 may be defined by a second technical standard for use with a second current or voltage rating, such as NEMA 6-20. Through the use of the key 320 on the electrical adapter 300 and the key socket 330 on the EV power adapter 315, the socket's use with plugs that do not have the complementary key recess is prevented to avoid inadvertent source-power overdraw or inadvertent overpowering of the component. Electrical connections are maintained between like terminals, such as a power plug blade 335 on the second side 318 of the electrical connector 300 and a power socket (not shown) on the first side 307 of the electrical connector 300.

Figure 4A:
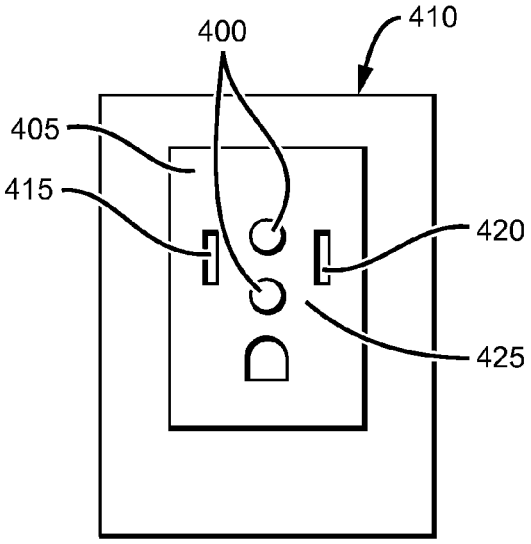
FIGS. 4A and 4B are top plan and side elevational views, respectively, of an embodiment of an electrical connector that has a socket key in the form of a plurality of posts.
Figure 4B:
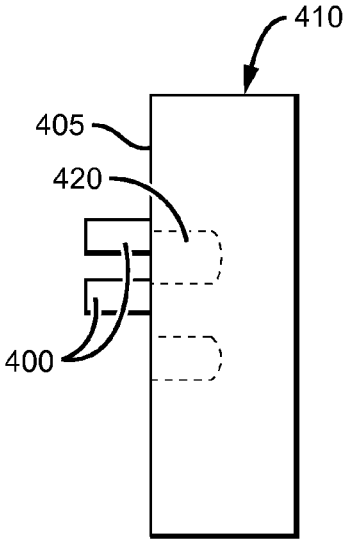

FIGS. 4A and 4B are top plan and side elevational views, respectively, of an embodiment of an electrical connector that has a socket key in the form of a plurality of posts. The key, preferably including posts 400, extends from a first side 405 (socket side) of the electrical connector 410 and is positioned between neutral and power slots (415, 420) of the socket face 425. Although the posts 400 are illustrated as generally aligned and centered between neutral and power slots (415, 420), the posts 400 may be positioned elsewhere on the adapter face 425, such as adjacent to the neutral and/or power slots (415, 420) or adjacent the ground slot. Also, the height of the posts may be sufficient two prevent seating of a plug into the socket slots (415, 420) unless the plug is provided with a complementary key recess to enable the posts 400 to adequately seat within the complementary key recess.

Figure 5A:
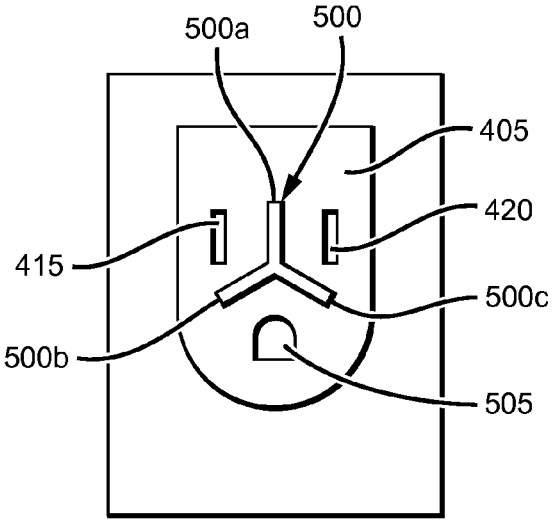
FIGS. 5A and 5B are top plan and side elevational views, respectively, of an embodiment that has a key configured as a walled structure.
Figure 5B:
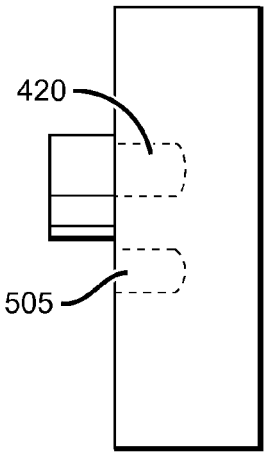

FIGS. 5A and 5B are top plan and side elevational views of an embodiment that has a key configured as a walled structure 500. The key, preferably a walled structure 500 that has three line segments (500*a*, 500*b*, 500*c*) with the first segment 500*a* extending parallel to neutral and power slots (415, 420) of a socket towards the ground slot 505, and second and third segments (500*b*, 500*c*) that split off from the first segment 500*a* to approach opposite sides of the ground socket 505. Although the walled structure 500 is illustrated as having a uniform height, in another embodiment, the walled structure 500 may have segments of different or varying heights to seat in a complementary socket recess.

Figure 6:
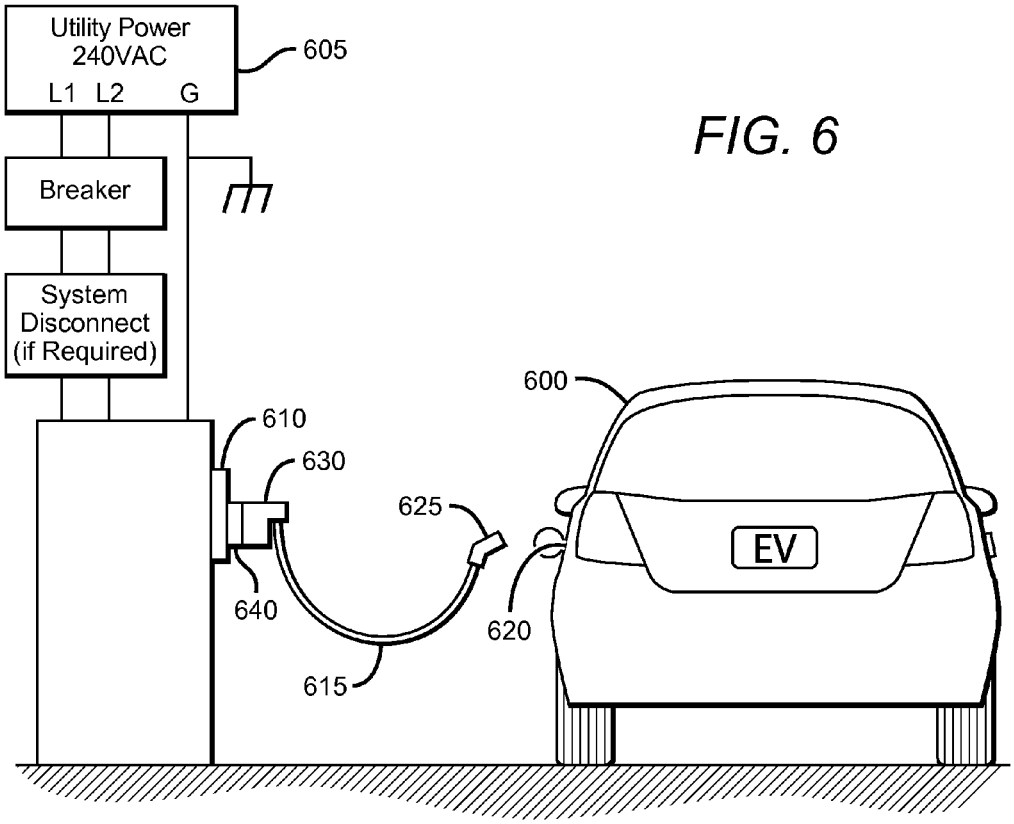
FIG. 6 is an exemplary embodiment of a plug-in hybrid electric vehicle ("PHEV") or electric-only vehicle, collectively referred to as an "EV," which is connected to a 220 VAC utility power source at a power receptacle through a cable and electrical adapter.

FIG. 6 is an exemplary embodiment of a plug-in hybrid electric vehicle ("PHEV") or electric-only vehicle, collectively referred to as an "EV" 600, that is connected to a 220 VAC utility power source 605 at a power receptacle 610 through a cable 615, EV power adapter 630, and electrical adapter 640. The EV 600 has a receiving port 620 that is configured to receive a connector 625, preferably a J1772 (type II) connector, which is connected to one end of the cable 615. The other end of the cable 615 has an EV power adapter 630 component having a key recess (not shown) and NEMA 5-15p plug to mate to a complementary key and NEMA 5-15s socket on a first side of an electrical adapter 640. The second side of the electrical adapter is configured with a NEMA 6-20p plug to electrically couple to a NEMA 6-20s power receptacle 610.

Figure 7:
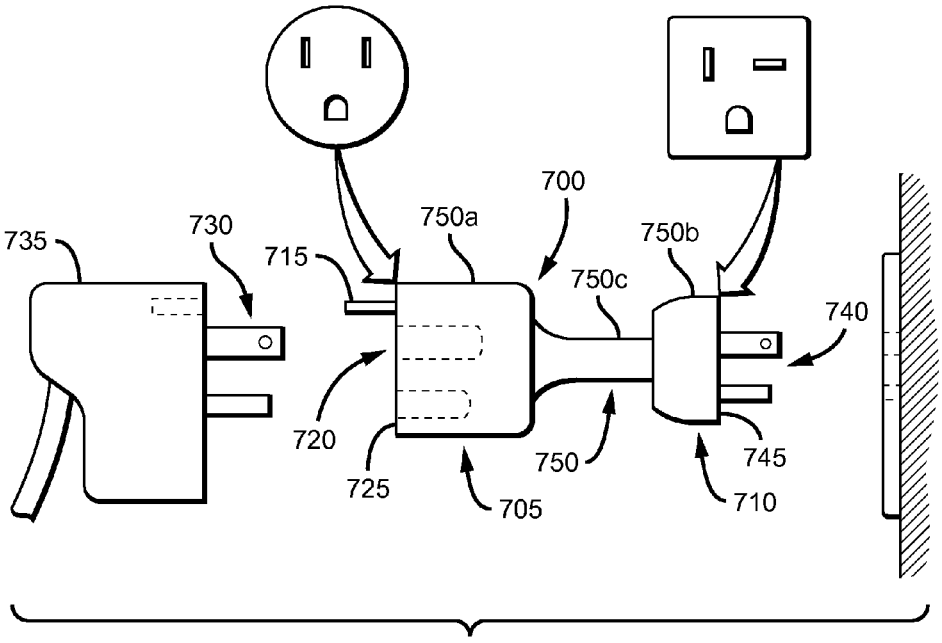
FIG. 7 depicts one embodiment of an electrical adapter that has a corded (alternatively referred to as a "flexible cable") form factor.

FIG. 7 depicts one embodiment of an electrical adapter that has a corded (alternatively referred to as a "flexible cable") form factor. The electrical adapter 700 has socket and plug ends (705, 710) defined by different respective technical standards, with the socket end 705 having a key 715 configured as a geometric frustum. The socket end 705 may be configured with a NEMA 5-15s socket 720 on a first side 725 of the adapter to connect with a NEMA 5-15p plug 730 of an EV power adapter 735. The electrical connector 700 may also be configured with a plug defined by a second technical standard, such as a NEMA 6-20p plug 740 on a second side 745. The electrical connections between the socket 720 and plug 740 are affixed to and contained within a housing 750 that may include two adapter prong housings (750*a*, 750*b*) and a cable 750*c*.

Figure 8A:
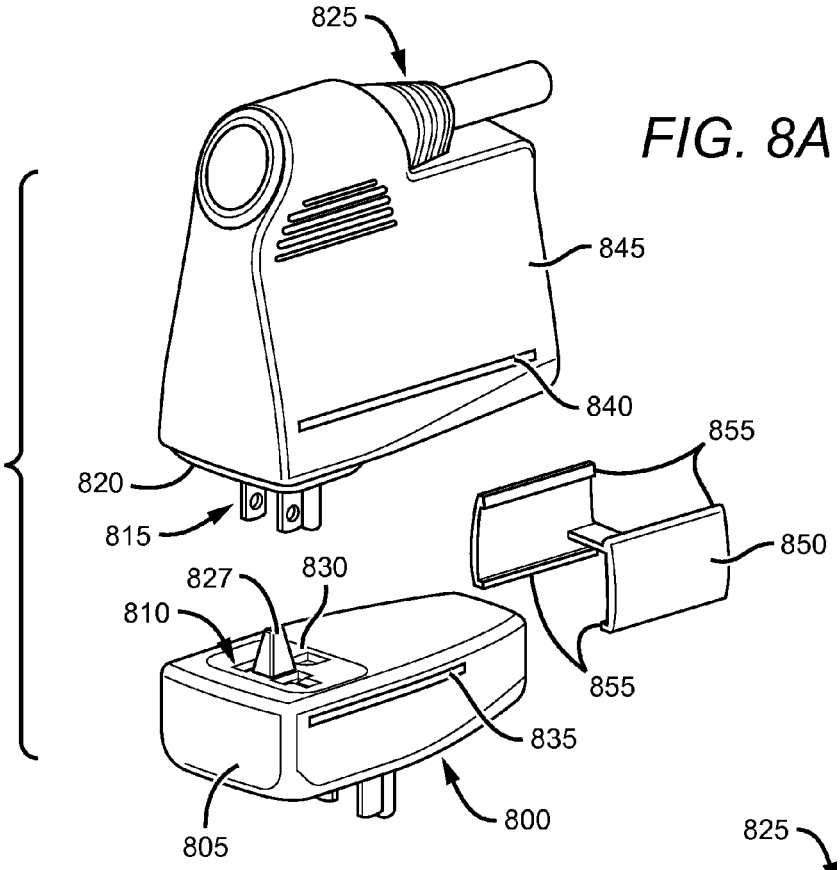
FIGS. 8A and 8B are an exploded perspective view and assembled view, respectively, of one embodiment of an electrical adapter and EV power adapter positioned in complementary opposition to each other, with a clip configured to detachably couple both together when assembled.
Figure 8B:
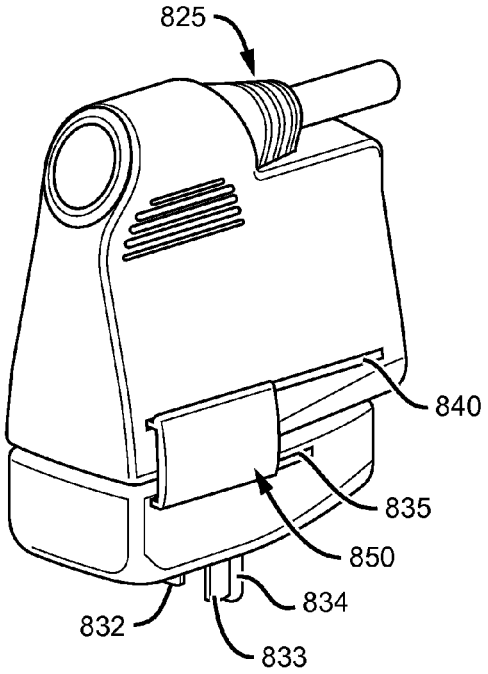

FIGS. 8A and 8B are an exploded perspective view and assembled view, respectively, of one embodiment of an electrical adapter and EV power adapter positioned in complementary opposition to each other, with a clip configured to detachably couple both together when assembled. In some embodiments, the clip may be tethered to the electrical adapter housing 805 by a coupler (not shown). The electrical adapter 800 may include an electrical adapter housing 805, with one side of the housing having an electrical socket 810 defined by a first technical standard, such as NEMA 5-15S. A plug 815 defined by a the same technical standard to that of the socket 810, such as NEMA 5-15P, extends from a first side 820 of the EV power adapter 825 for slidable coupling with the socket 810. A key 827 extends up from a first side 830 of the adapter 800 and is configured to seat in a complementary key recess (not shown) in the EV power adapter 825 such that the plug 815 is capable of fully seating in the socket 810. As illustrated, the key 827 is in the shape of a geometric prism such as a peg. In an alternative embodiment, the key 827 may be formed in the shape of a plurality of protrusions. The key 827 may be centered between the power and neutral plug blades (832, 833) or may be disposed adjacent or about the power 832, neutral 833, or ground plugs 834. For example, if the key is a wall structure, the key may extend between the power and neutral plug blades and may be straight or serpentine.

The electrical adapter 800 may have longitudinal slots 835 formed in opposite sides of the electrical adapter housing 805. Similarly, the EV power adapter 825 may have longitudinal slots 840 formed in opposite sides of an EV adapter housing 845. The longitudinal slots (835, 840) are configured to receive and detachably couple to an adapter coupler such as a clip 850 after the plug 815 of the EV power adapter 825 is fully seated in the socket 810 of the electrical adapter 800. The clip 850 has two pairs of longitudinal tabs 855, one pair for each of the EV power adapter 825 and electrical adapter 800, respectively, with each tab 855 configured for complementary engagement with the longitudinal slots (835, 840). The clip may be substantially rigid, but flexible enough to slide into and seat in the longitudinal slots (835, 840). In one embodiment, the clip 850 is plastic. In other embodiments, the clip 850 may be metal, or some combination of metal and plastic.

Figure 9:
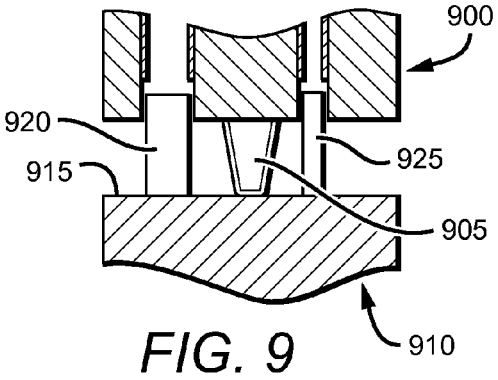
FIG. 9 is a cross section view illustrating one embodiment of a key protrusion on a face of a socket that is configured to prevent insertion of a non-compatible plug.

FIG. 9 is a cross section view illustrating one embodiment of a key protrusion on a face of a socket that is configured to prevent insertion of a non-compatible plug. A socket 900, such as a socket defined by the NEMA 5-155 standard, is provided with a key 905, such as a peg-shaped geometric frustrum. The key may be molded as part of the socket 900, or may be an add-on component coupled to the docket 900. A plug 910 is illustrated positioned in complementary opposition to the socket 900, with a face 915 of the plug abutting the key 905 such that neutral and power blades (920, 225) do not extend adequately to seat into the socket 900. As a result, an electrical connection between socket 900 and plug 910 is prevented.

While various implementations of the application have been described, it will be apparent to those of ordinary skill in the art that many more embodiments and implementations are possible that are within the scope of this invention.

We claim:

1. A system, comprising:

an adapter comprising:

a socket defined by a first technical standard and comprising a neutral socket, a power socket, and a ground socket;

a plug defined by a second technical standard and comprising a neutral blade, a power blade, and a ground blade;

at least one key extending out from a face of the socket; and an adapter housing, wherein the socket and the plug are disposed on opposing sides of the adapter housing;

an electric vehicle ("EV") power adapter, the EV power adapter comprising:

a second plug compatible with the first technical standard and comprising a second neutral blade, a second power blade, and a second ground blade; and at least one complementary key socket extending inward from a face of the second plug, wherein the at least one complementary key socket is aligned with the at least one key of the adapter;

wherein the socket of the adapter is configured to receive the second plug wherein the at least one complementary key socket is aligned with the at least one key of the adapter, wherein the at least one complementary key socket is configured to receive the at least one key so as to electrically couple the second neutral blade to the neutral socket and the neutral blade, electrically couple the second power blade to the power socket and the power blade, and electrically couple the second ground blade to the ground socket and the ground blade.

2. The system of claim 1 wherein the at least one key is configured to prevent electric coupling of a device comprising a third plug with the adapter comprising the socket if the third plug does not have at least one complementary key socket aligned with the at least one key of the adapter.

3. The system of claim 1 wherein at least one of the at least one key is disposed between the power socket and the ground socket of the socket of the adapter.

4. The system of claim 1 wherein at least one of the at least one key is a geometric frustum.

5. The system of claim 1 wherein at least one of the at least one key is straight and serpentine.

6. The system of claim 1 wherein at least one of the at least one key is serpentine.

7. The system of claim 1 wherein at least one of the at least one key is comprised of at least one of: a rigid thermoplastic, a rigid thermosetting polymer, metal, and ceramic.

8. The system of claim 1 wherein the adapter comprises two keys.

9. The system of claim 8 wherein the two keys are aligned and centered between the neutral socket and the power socket of the socket of the adapter.

10. The system of claim 8 wherein the two keys are positioned adjacent to the neutral socket of the socket of the adapter.

11. The system of claim 8 wherein the two keys are positioned adjacent to the power socket of the socket of the adapter.

12. The system of claim 8 wherein the two keys are positioned adjacent to the ground socket of the socket of the adapter.

13. The system of claim 1 wherein at least one of the at least one key comprises a walled structure.

14. The system of claim 13 wherein the walled structure separates each of the neutral socket, the power socket, and the ground socket on the face of the socket.

15. The system of claim 13 wherein the walled structure is a uniform height.

16. The system of claim 13 wherein the walled structure is a varying height.

17. The system of claim 1 wherein the adapter housing is generally rectangular in cross-section.

18. The system of claim 1 wherein the adapter housing is comprised of at least one of: a rigid thermoplastic and a rigid thermosetting polymer.

19. The system of claim 1 wherein the adapter housing further comprises a flexible portion, the flexible portion disposed between the socket and the plug.

20. The system of claim 1 wherein the adapter housing further comprises one or more longitudinal slots to receive a clip for slidable coupling with the EV power adapter comprising the second plug.

21. The system of claim 1 wherein a power rating associated with the second technical standard is greater than a power rating associated with the first technical standard.

22. The system of claim 1, wherein the first technical standard is National Electrical Manufacturers Association ("NEMA") 5-15 standard.

23. The system of claim 22, wherein the second technical standard is selected from the group consisting of NEMA 6-15, NEMA 5-20, and NEMA 6-20standards.

24. The system of claim 1, wherein at least one of the at least one key is a peg.

25. The system of claim 1, wherein at least one of the at least one key comprises a plurality of protrusions.

26. The system of claim 1, wherein the adapter housing comprises a flexible cable connecting the socket and the plug.

27. The system of claim 1 wherein the neutral socket is electrically coupled to the neutral blade, the power socket is electrically coupled to the power blade, and the ground socket is electrically coupled to the ground blade.

* * * * *